US008328568B2

(12) United States Patent
Littek et al.

(10) Patent No.: US 8,328,568 B2
(45) Date of Patent: Dec. 11, 2012

(54) PLUG-IN CONNECTOR

(75) Inventors: Martin Littek, Korb (DE); Andreas Michael Schremmer, Berglen (DE); Bernd Hagmann, Bad Ueberkingen (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 13/208,734

(22) Filed: Aug. 12, 2011

(65) Prior Publication Data

US 2012/0058656 A1 Mar. 8, 2012

(30) Foreign Application Priority Data

Sep. 7, 2010 (DE) ..... 10 2010 045 471

(51) Int. Cl.
*H01R 13/62* (2006.01)

(52) U.S. Cl. ..... 439/157

(58) Field of Classification Search ..... 439/157, 439/372, 152, 160

See application file for complete search history.

(56) References Cited

U.S. PATENT DOCUMENTS

| | | | | |
|---|---|---|---|---|
| 5,171,156 | A * | 12/1992 | Nagasaka et al. | 439/157 |
| 5,201,665 | A | 4/1993 | McCardell, Jr. et al. | |
| 5,205,752 | A * | 4/1993 | Taguchi et al. | 439/157 |
| 5,924,980 | A * | 7/1999 | Coetzee | 600/300 |
| 6,612,854 | B2 * | 9/2003 | Takata | 439/157 |
| 8,011,938 | B2 * | 9/2011 | Martin et al. | 439/157 |
| 2002/0022391 | A1 * | 2/2002 | Beck et al. | 439/157 |

FOREIGN PATENT DOCUMENTS

| | | | |
|---|---|---|---|
| DE | 69500824 | T2 | 2/1998 |
| DE | 69806288 | T2 | 11/2002 |
| DE | 10201006742 | A1 | 9/2010 |
| FR | 2803111 | A1 | 6/2001 |

* cited by examiner

*Primary Examiner* — Edwin A. Leon
*Assistant Examiner* — Harshad Patel
(74) *Attorney, Agent, or Firm* — Leon D. Rosen

(57) ABSTRACT

A connector (10) for systems of high power density includes a first (female) plug-in unit (11), a second (male) plug-in unit (12), and gear wheels (65) with spiral tracks (67) that engage cams (28) that move the units together.

9 Claims, 7 Drawing Sheets

PLUG-IN CONNECTOR

CROSS-REFERENCE

Applicant claims priority from German patent application DE 10 2010 045 471.0 filed Sep. 7, 2010.

BACKGROUND OF THE INVENTION

The present invention relates to a plug-in connector device, in particular for systems of high power density such as in charging electric autos.

In order to transmit high currents, contacts in high-performance plug-in connector devices are used that feature high contact forces and large plug-in forces, associated therewith. Usually these plug-in connector devices are joined together using supplemental devices such as locking nuts along with a bayonet groove or an activation lever with corresponding contours. These supplemental devices require comparatively large installation space because they require large activation paths to achieve sufficiently effective force amplification.

High-performance plug-in connector devices are in demand most of all in the automotive industry for electrically operated vehicles, by way of example, where manufacturing costs represent a significant criterion, on the one hand, and the installation space in vehicles is very limited by their very nature, on the other hand. Nevertheless, good access is necessary for maintenance purposes. In addition, unauthorized access to the plug-in connector device should be prevented, or any successful intrusion should be indicated.

It is the objective of the present invention to create a plug-in connector device of the aforementioned type, which can be used despite the limited scope of the vehicle installation space while preserving good access for maintenance purposes, and which is technically simple in production terms.

SUMMARY OF THE INVENTION

A first plug-in unit has a rotatable disk with a spiral track, and a cam on the other plug-in unit engages the track. By simply rotating the disk, the two plug-in units may be fitted together, i.e., pulled together, forcefully over a relatively long activation path during the plug-in process.

A smooth plug-in process is assured due to the symmetrical arrangement and mode of action of two disk elements.

A curved spiral track is achieved that is simple to activate, on the one hand, and the possibility is gained, on the other hand, of achieving a force amplification based on the changing slope of the curved track towards the end of the activation path.

The disk elements are not only carriers of the curved track but at the same time also form parts of a gear mechanism which transmits the input drive motion, imparted by a tool, from the drive pinion to the output drive gear wheels, which are identical in construction, in parallel and at the same magnitude. In other words, the output drive wheels, preferably in the form of crown wheels, are also configured for the two aforementioned modes of operation. The disk elements, i.e., the gear wheels, can be advantageously manufactured of plastic using injection molding processes, which keeps the manufacturing costs low, given the anticipated quantities. Based on the gear mechanism geometry, the crown wheels, which are driven in opposite directions, can be identical. In order to prevent unauthorized access, the drive pinion is advantageously provided with a tool access that advantageously deviates from the standard type.

A space-saving arrangement is provided that accommodates the disk elements, i.e., the crown wheels and the drive pinion, within the exterior housing of the relevant plug-in unit.

Good force amplification results because gear reduction is also ensured by the selection of the diameter ratios.

The cams are guided so that they can be deflected in an elastically resilient manner and can be axially pre-stressed in the relevant curved track. The latching elements, including the cams, are integrated by means of an opening in the electrically conductive wall parts so that they are locked in place therein.

During the plug-in process the wall parts of the first plug-in unit engage over the relevant side walls of the second plug-in unit.

Further details of the invention may be seen in the following description, in which the invention is described and explained in greater detail on the basis of the exemplary embodiments that are depicted in the drawing.

DESCRIPTION OF THE INVENTION

Figure 1:
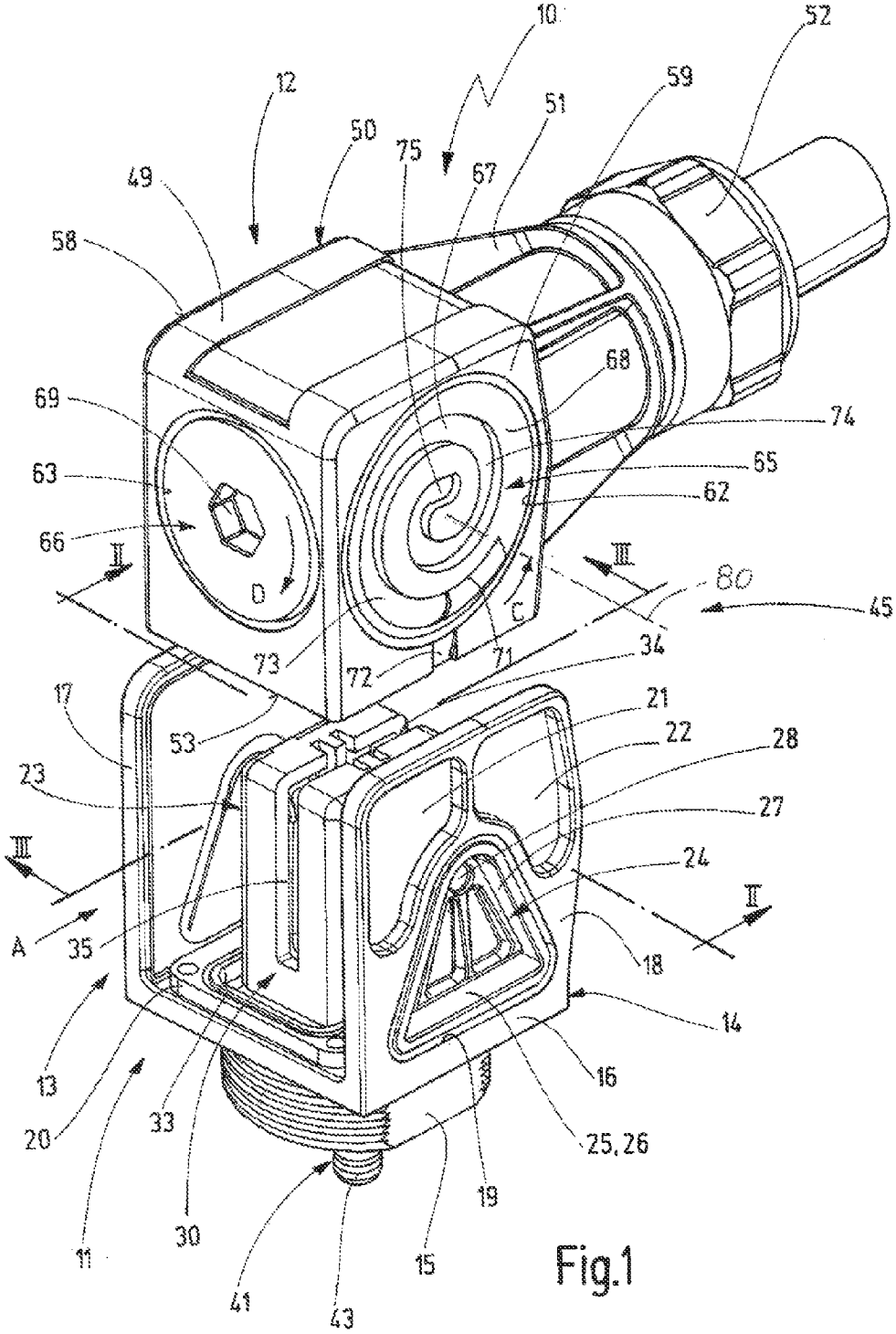
FIG. 1 is an isometric view of a first (female) plug-in unit as well as a second (male) plug-in unit of the plug-in connector device according to one embodiment of the invention.

Electrical plug-in connector device 10, 110, 210, as depicted in the drawings in accordance with several exemplary embodiments, is designed especially for plug-in connections of high transmission power, i.e., high specific power density, as is the case in electrically operated motor vehicles, for example.

Figure 2:
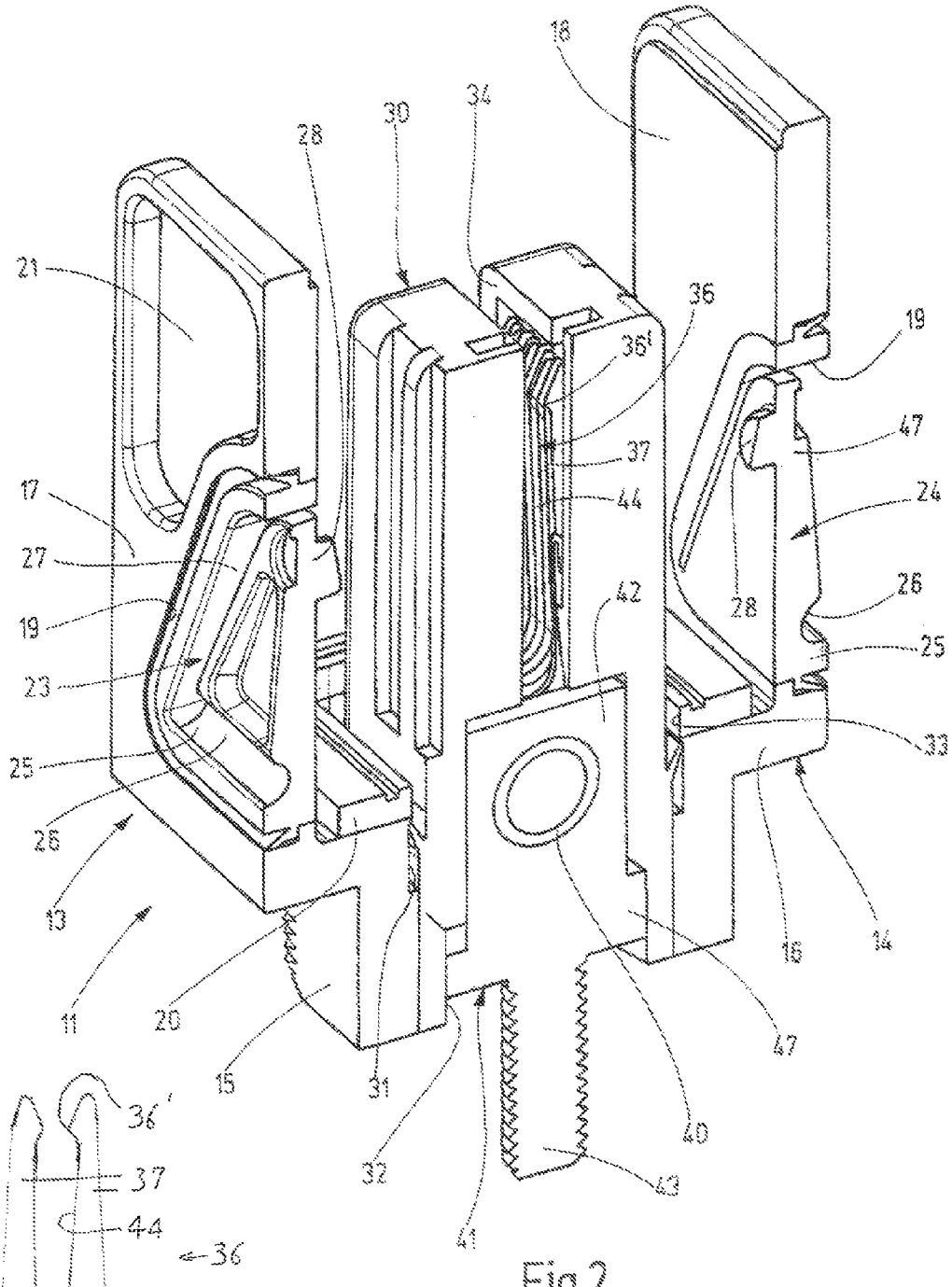
FIG. 2 is a cutaway isometric view along the line II-II of the first plug-in unit shown in FIG. 1.
Figure 3:
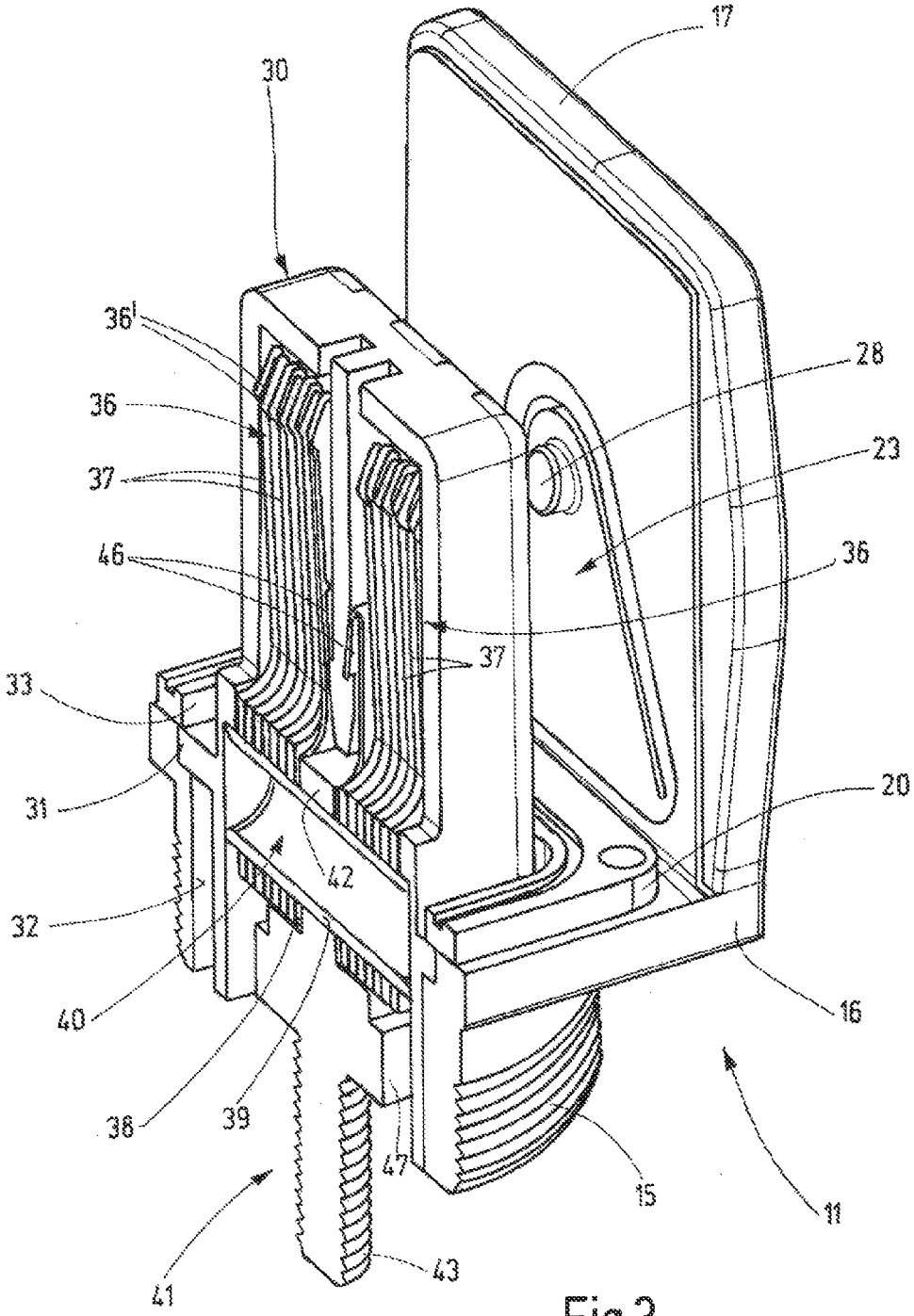
FIG. 3 is a cutaway view along the line III-III of the first plug-in unit shown in FIG. 1.
Figure 4:
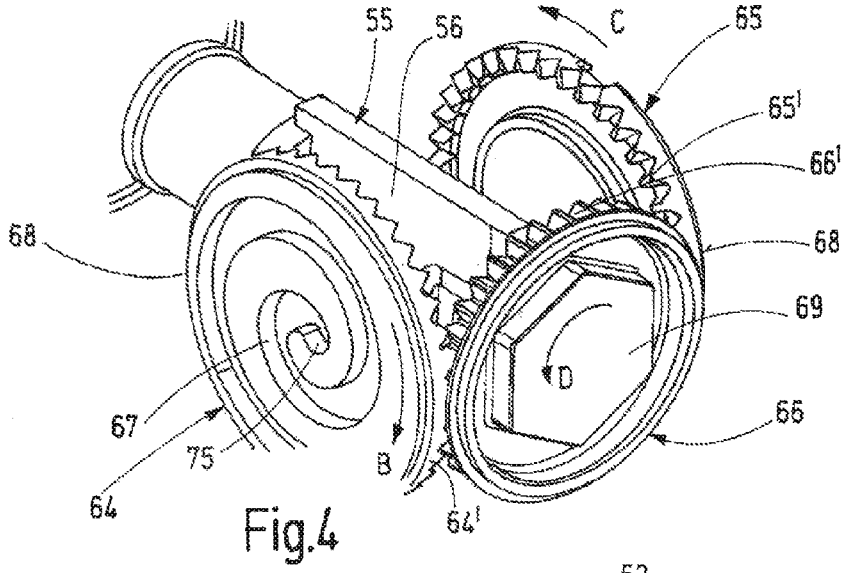
FIG. 4 is an isometric and cutaway representation of the second plug-in unit showing the drive mechanism for a force-fitting plug-in connection of the two plug-in units.
Figure 6:
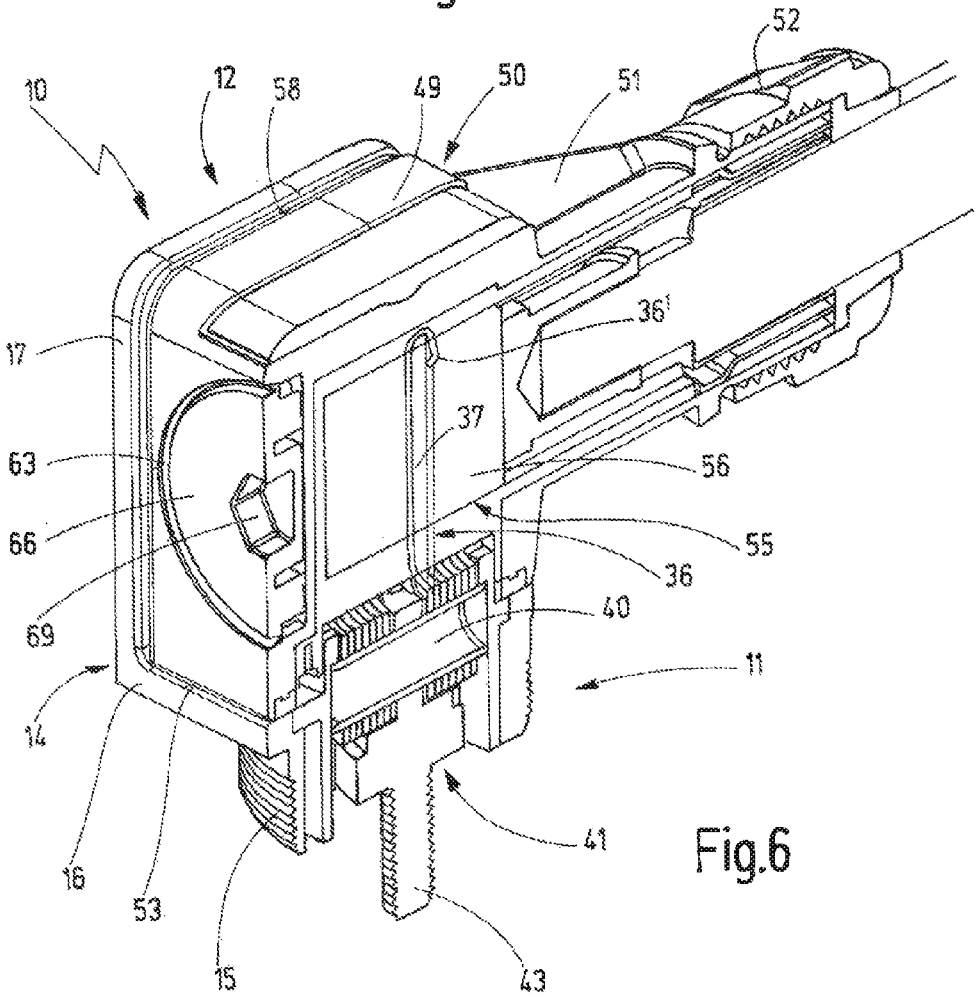
FIG. 6 is a sectional isometric view taken on line VI-VI in FIG. 5, but in a completely plugged-together state of the first and second plug-in units.
Figure 5:
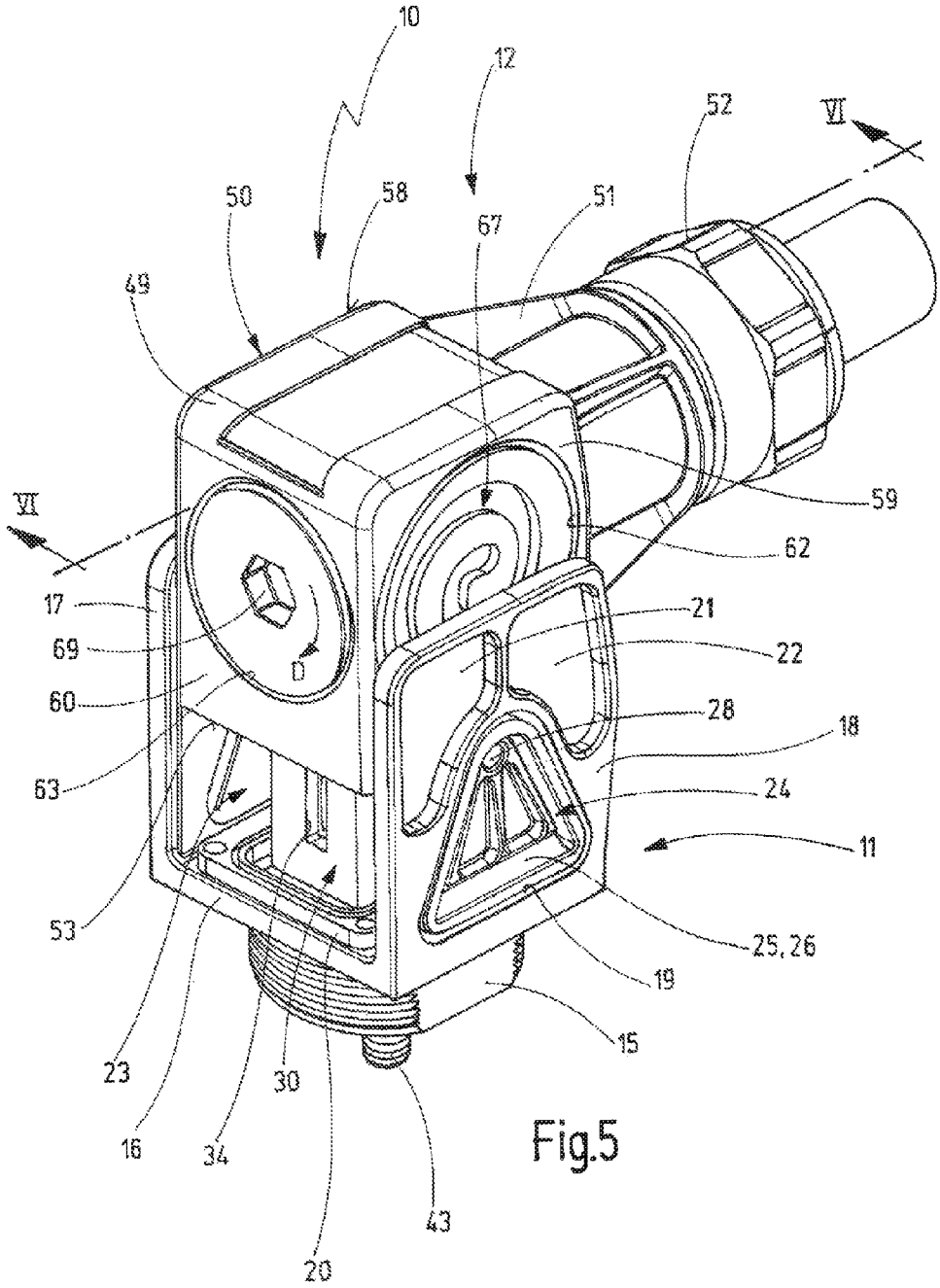
FIG. 5 is an isometric view that depicts a pre-connection step in the electrically conductive plug-in process of connecting the first and second plug-in units of the plug-in connector device in accordance with the invention as depicted in FIG. 1.

FIGS. 1, 2, and 3 show a first (female) plug-in unit 11, which can be used both in a plug-in connector device 10 according to FIGS. 1, 5, and 6, as well as in a plug-in connector device 110 according to FIGS. 7 and 8, along with a second (male) plug-in unit 12 (FIGS. 1 and 4) and 112 (FIGS. 7 and 8).

First plug-in unit 11 (FIG. 1) has an open housing 13 that is made of any material, said housing being made of an electrically conductive material or being provided with an electrically conductive layer in the event an electromagnetic shielding is part of the design, whereby housing body 14 when seen in a front view A has a U-shaped configuration and is integrally provided with an external threaded projection 15 for through-hole mounting on a fixed component. Housing body 14 has a base 16, on each of whose two opposite longitudinal sides an identical, vertically protruding wail part 17, 18 protrudes as an integral part. Both parallel wall parts 17, 18 face base 16 and are furnished with a through-opening 19 that is trapezoidal or triangular in shape and, above said through-opening 19, with recesses 21, 22 that proceed from the exterior side. Facing away from both wall parts 17, 18, base 16 on its lower side is provided with integral external threaded projection 15.

A latching element 23, 24, made of plastic, for example, and having the shape of through-opening 19, is introduced into the through-opening 19. Base area 25 of each latching element 23, 24 is held in latching fashion within through-opening 19 and is weakened in its thickness by a hollow groove 26, forming a film-like hinge, so that triangular area 27 above base area 25 is supported in such a way that it can be deflected in an elastically resilient manner. In the apex area of each latching element 23, 24, a latching cam 28 is molded so as to point to the interior of housing body 14.

Within housing body 14, an electrical insulating-material body 30 is arranged, which accommodates a female contact arrangement 35. The contact arrangement is positioned over an essentially longitudinal area of both wall parts 17, 18 of housing body 14, being centrally located between the latter, so the contact arrangement penetrates cutouts 31, 32, and 33 (FIG. 2) that are located in base 16, and extends through external threaded projection 15, and a rubber seal 20 that contacts base 16. With its end facing away from wall parts 17, 18, the body essentially terminates in alignment with the annular end of external threaded projection 15. Insulating-material body 30 may be slid between wall parts 17, 18 through cutouts 31 to 33 and may be held between external threaded projection 15 and seal 20 in latching fashion.

Figure 2A:
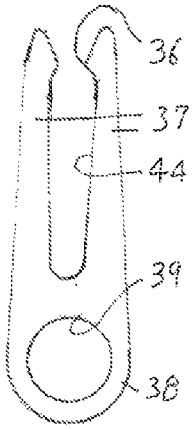
FIG. 2A is an elevation view of one of the spring contacts of FIG. 2.

Female contact arrangement 35 (FIG. 1), employed in the exemplary embodiment depicted, is made up of two packets that are arranged next to each other with spacing and are made up of multiple metal spring contacts 36 (FIG. 2A). Spring contacts 36, which in the exemplary embodiment are configured so as to be identically cut from flat metal plate, each have two parallel, elastically deflectable legs 37, which have a U-shape, form a receiving slot 44 between them, and have a base 38 which is provided with a through borehole 39. By means of through boreholes 39, spring contacts 36, which are stacked, are individually provided with contact points 36', that engage opposite faces of blade contact 56. The spring contacts are lined up on a tubular metal carrier 40 and are attached by being strung in packets so as to be in close contact with each other. One end of a holder 41, whose other end 43 is configured as an external threaded pin, is fixedly supported on tubular carrier 40 in the center between the two packets of spring contacts 36. An annular collar 47, by which contact arrangement 35 (FIG. 1) is guided within the lower area of insulating-material body 30, is integrally provided between both ends 42, 43 (FIG. 2). A locking hook 46, which facilitates the locking of contact arrangement 35 within insulating material body 30, is attached between the two adjacent packets of spring contacts 36 on tubular carrier 40.

FIGS. 1 and 4 to 6 show the second (male) plug-in unit 12 has a roughly cuboid housing 50, which is provided with a plug-in aperture 53 (FIG. 6) on a side wall or end wall for accommodating the first (female) plug-in unit 11. On a second end face, housing 50 is furnished with a bushing 51 and a cable strain relief device 52, in the form of a screw connection, for example, for accommodating a connecting unit of a second (male) electrical contact arrangement 55 (FIG. 6). The second contact arrangement can be, or has been, connected to the stripped cable end, and is configured in the form of a blade contact 56 in the exemplary embodiment.

Housing 50 (FIG. 6) has a hollow body 49 that can be made of any material, and is preferably made of an electrically conductive material or an electrically conductive layer in the event an electromagnetic shielding is part of the design. If it is made of electrically conductive material, the housing body is lined with an insulating material that is not represented in detail, and has cutouts 61, 62, 63 (FIG. 1). The cutouts lie on two opposite longitudinal side walls 58, 59 and on an end wall 60 (FIG. 5), that connects the side walls 58, 59 into which a gear wheel 64, 65, 66 is inserted so that it can rotate. Cutouts 61, 62, 63 are advantageously configured as bearing shells that are incorporated into the relevant wall. In the exemplary embodiment, gear wheels 64 to 66 (FIG. 4) are configured as crown wheels having toothed rims 64, 65, 66 that point to the interior of housing body 49. Both opposite, parallel-arranged gear wheels 64, 65, which can also be designated as output drive gear wheels, have a toothed rim of a greater diameter than input drive gear wheel 66. The drive gear wheel 66 is arranged on the end face side and its toothed rim engages both gear wheels 64, 65 with one gear wheel 64 and with other gear wheel 65. Both identical output drive gear wheels 64, 65 rotate in opposite directions about axis 80 in accordance with arrows B and C, provided that input drive gear wheel 66 is moved in direction D (or vice versa). In this way, gear wheels 64 to 66 constitute a reduction gear.

Input drive gear wheel 66, which can move in the axial direction, has on its exterior side a tool receptacle 69, by means of which input drive gear wheel 66 may advantageously be rotated using a special tool in one direction (arrow D) or the other (opposite arrow D). Both output drive gear wheels 64, 65, on their disk surface 68 facing outside have a curved cam track 67 of the same configuration. Curved track 67 facilitates the reception of latching cam 28 (FIG. 2) of latching element 23, 24 in housing body 14 of first (female) plug-in unit 11, as will be described below on the basis of FIGS. 1, 5, and 6. Curved track 67 has an access area 71 (FIG. 1), which in an initial rotational position of gear wheel 64, 65 is aligned with a groove 72 that emerges from a longitudinal edge of side wall 58, 59. Adjacent to said access area is an area 73 having a relatively gentle slope (small angle to circumferential direction) and beyond that an area 74 having a somewhat steeper slope. Curved track 67 terminates in a linear area 75 which functions as a limit stop. In this way, gear wheels 64, 65 serve a double function.

The spiral track 67 (FIG. 1) on the wheel 65 extends as a spiral along a majority of its curved length, that is, a cam 28 engaged with the track 67 continually receded or approaches the first axis 80 as the wheel 65 and its track continually rotate in one direction. It can be seen in FIG. 1 that the track 67 extends by more than one-half turn (180°) about the axis 80, and preferably extends by more than one full turn (360°) about the axis 80.

As can be seen from the preceding design explanations with regard to both plug-in units 11, 12, plug-in units 11, 12 may be joined to form plug-in connector device 10 by being brought into and over each other, whereby the joining together and the force-fitting holding together are accomplished by a locking device 45, which is constituted by interpenetrating components 23, 24, 28, and 64, 65, 67 on first plug-in unit 11 and second plug-in unit 12, respectively.

Proceeding from FIG. 1, the initial state is depicted for the plug-in connecting process of both plug-in units 11 and 12. A first (female) plug-in unit 11 is being fixedly held, and a second (male) plug-in unit 12 is brought down, with the open side 53 of housing body 50 lying between the former's two wall parts 17, 18 and over insulating-material body 30. In this context, said two longitudinal side walls 58, 59, which are furnished with gear wheels 64, 65, are inserted into the spaces between insulating-material body 30 and respective wall part 17, 18 in such a way that both latching cams 28 (FIG. 2) within wall parts 17, 18 move via side-wall groove 72 (FIG. 1) into adjacent linear access area 71 of curved track 67. The spiral track 67 has been placed in the appropriate position. In this context, latching cams 28 (FIG. 2) contact the base of curved track 67 and are elastically pre-stressed. In this preparatory plug-in state, depicted in FIG. 5, the front, free ends of spring contacts 36 (FIG. 2) are still positioned within the entry area of housing body 49 and therefore are still not in contact with blade contact 56 (FIG. 6).

To create the electrically conductive connection of the two, i.e., to complete the plug-in process between both plug-in units 11, 12, preferably using a special tool, input drive gear wheel 66 (FIG. 1) on second (male) plug-in unit 12 is rotated via tool receptacle 69 in corresponding direction D. The result is that, based on the motion-locking guidance of latching cam 28 within curved track 67, a further plug-in motion of second (male) plug-in unit 12 into first (female) plug-in unit 11 is caused, until latching cams 28, which are guided within curved tracks 67, come into contact with linear end 75 of curved track 67. Due to the shape of curved track 67, a kind of bayonet locking projected into the plane is achieved in the corresponding force-fitting, final locking state. In this position, blade contact 56, which penetrates through a slot arrangement 34 (FIG. 2) in insulating-material body 30 into the latter, is completely held between the two packets of spring contacts 36, or on their contact points 36', which are elastically pre-stressed.

In the end state of the plug-in connection, an electromagnetic shielding of the contacting is achieved by a material-based configuration of housing bodies 14, 49 of both plug-in units 11, 12 and of seal 20, which are made of, or employ a layer that is made of, an electrically conductive material.

The plug-in connection is correspondingly disengaged in reverse fashion, i.e., by counter-rotating input drive gear wheel 66 (FIG. 4), which results in disengaging the electrical contact between electrical blade contact 56 and electrical spring contacts 36 (FIG. 2).

If a second (male) plug-in unit 12 is used in which there is a right angle between cable bushing 51 and plug-in aperture 53 for the first (female) plug-in unit 11, it is obvious that the second (male) plug-in unit 12 may also be configured in linear fashion, so that a plug-in connector device 10 is provided that is in linear alignment instead of being at a right angle.

Figure 7A:
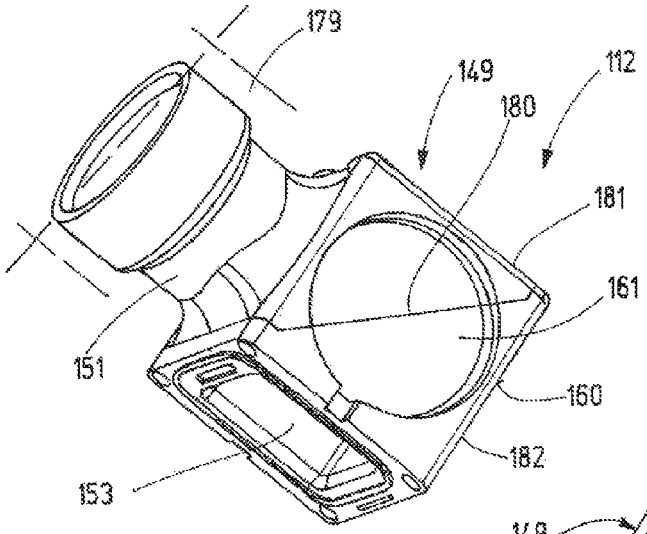
FIGS. 7A and 7B are isometric views that depict two variants of a second embodiment of a second plug-in unit having a two-part housing.
Figure 7B:
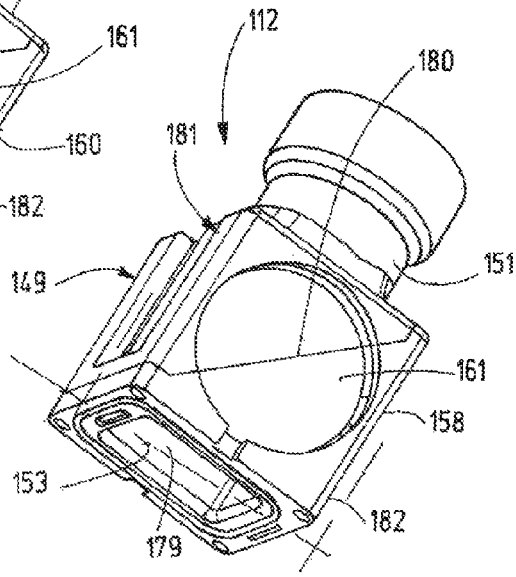

FIGS. 7 and 8 indicate a further (second) embodiment of a second (male) plug-in unit 112, in which body 149 of cuboid housing 150, which is open on one side, is configured in two parts in such a way that two housing parts 181, 182 are created that are divided at a 45° angle. Division plane 180 of housing body 149 is vertical on its central longitudinal plane 179 and runs on a 45° diagonal between two corner edges. Depending on how the housing parts are joined, the direction of cable-accommodating bushing 151 and the plug-in direction, i.e., the direction of plug-in aperture 153 for first (female) plug-in unit and mating plug-in unit 11, run either perpendicular to each other, as shown in FIG. 7A, or in a linear, i.e., 180° arrangement, as shown in FIG. 7B.

Figure 8B:
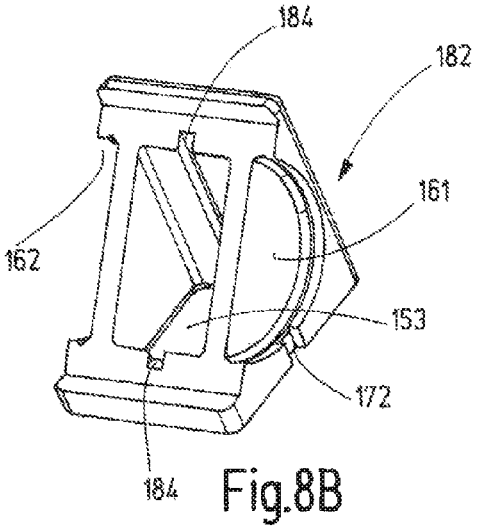
FIGS. 8A and 8B are isometric views that depict one of the two parts of the housing of the second plug-in unit according to the second embodiment.
Figure 8A:
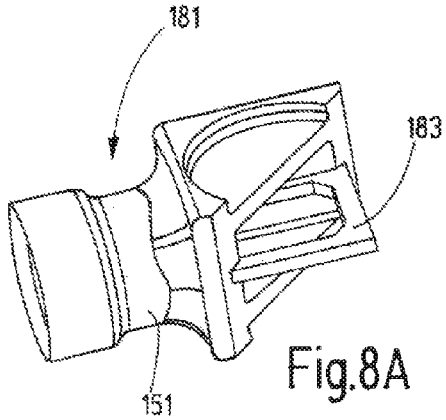

According to FIG. 8A, housing part 181 is provided with bushing 151 and has in its central interior area a frame part 183 as contact protection, within which blade contact 56, not depicted here, is accommodated. Frame part 183 also facilitates the guided accommodation of second housing part 182, which is depicted in FIG. 8B and which has corresponding guide grooves 184 for frame part 183 and plug-in aperture 153. Therefore, rectangular blade contact 56 faces plug-in aperture 153 either with its longitudinal edge (FIG. 7A) or with a free front edge (FIG. 7B). Cutouts 161, 162 for undepicted gear wheels 64, 65 are indicated accordingly and are shaped in the form of bearing shells. The cutout for the input drive gear wheel is provided either on a front side 160 (FIG. 7A) or on a longitudinal side 158 (FIG. 7B) between cutouts 161, 162.

Figure 9B:
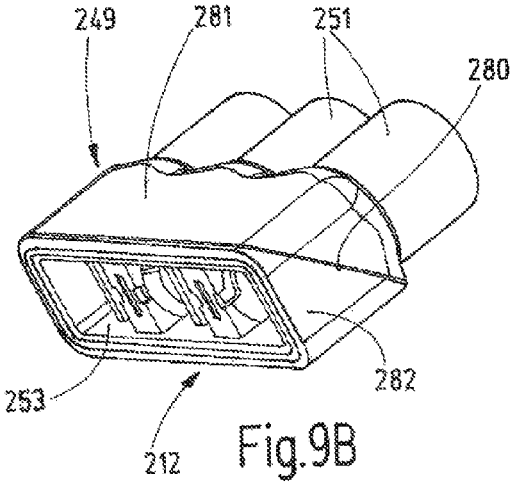
FIGS. 9A and 9B are isometric views that depict two variants of a third embodiment of a second plug-in unit that is similar to FIGS. 7A and 7B, but in a multi-pole embodiment.
Figure 9A:
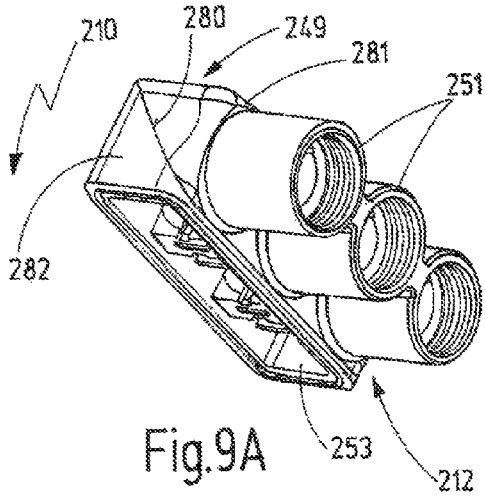
Figure 10A:
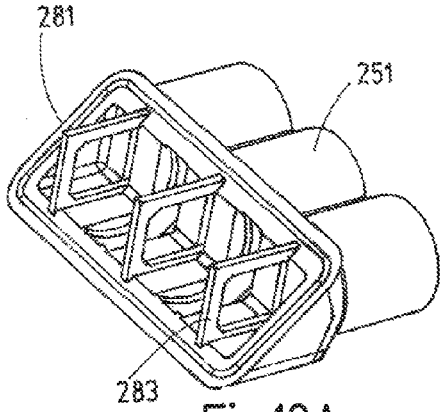
FIGS. 10A and 10B are isometric views that each depicts one of the two parts of the housing of the second plug-in unit according to the third embodiment.
Figure 10B:
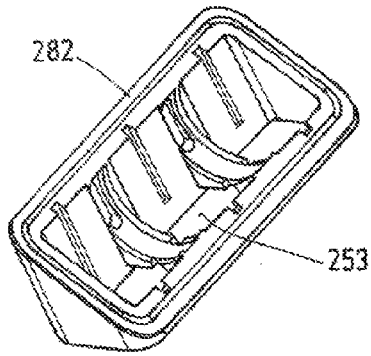

FIGS. 9 and 10 depict a further (third) exemplary embodiment of a second (male) plug-in unit 212 for a multi-pole plug-in connector device 210. This multi-pole, second plug-in unit 212 is essentially formed by creating a lateral row of single-pole, second plug-in units 12, whereby multi-pole, second plug-in unit 212, depicted here, is formed by creating a row of multiple (in this example, three) second plug-in units 112 in accordance with FIGS. 7 and 8. In other words, this multi-pole, second plug-in unit 212, as was the case with second plug-in unit 112 which was designed as a single-pole device, is divided in its housing body 249 into two housing parts 281, 282 along division plane 280 at an angle of 45°, in such a way that, in accordance with FIGS. 9A and 9B, the choice exists as to whether the direction of cable bushing 251 and the direction of insertion, i.e., the direction of plug-in aperture 253 in a first (female) plug-in unit 211 and a mating plug-in unit (FIG. 11), are arranged perpendicular to each other or in linear fashion (180°).

Figure 11:
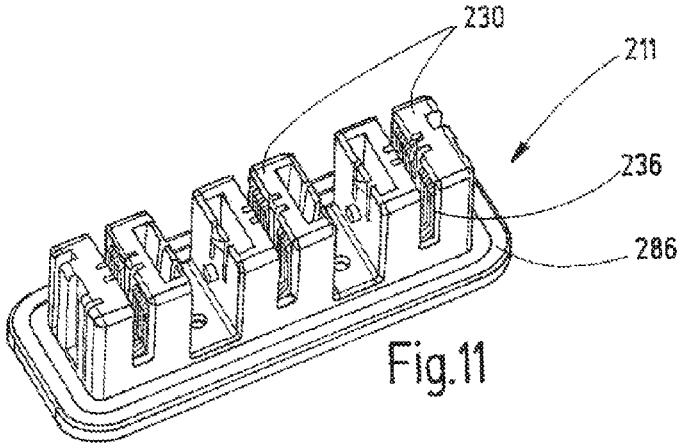
FIG. 11 is an isometric view that depicts a first plug-in unit in a multi-pole embodiment for the electrically conductive plug-in connection with one of the second plug-in units shown in FIGS. 9A and 9B.

FIG. 11 shows a multi-pole, first (female) plug-in unit 211, which is essentially based on multiple first (female) plug-in units 11, preferably on a common base plate 286 without wail parts. Multi-pole, first plug-in unit 211 is the mating plug-in unit for aforementioned multi-pole, second plug-in unit 212.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector (10) which includes first and second units (11, 12) that can be moved into connection with each other, wherein:

said second unit (12) includes a second housing (50) and a first wheel (65) that is rotatably mounted on the second housing about a first axis (80), said wheel (55) forming a spiral track (67) that extends at least 180° about said first axis and in a spiral along a majority of the spiral track length;

said first unit (11) has a first housing (14) and has a first cam (28, FIG. 2) that is mounted on said first housing and that is engaged with said track and positioned so as said wheel turns in a first direction said second unit is moved into connection with said first unit.

2. The connector described in claim 1 wherein:

said second unit has opposite sides and has a pair of wheels (64, 65) with one wheel at each of said sides and with said wheels having corresponding spiral tracks;

said first unit forms a pair of cams that are each engaged with one of said spiral tracks.

3. The connector described in claim 1 wherein:

said first wheel is rotatable and has a primarily flat surface and said spiral track comprises a spiral groove in said flat surface, with said spiral groove having a radially outer end (71);

said first housing has a stationary radially-extending second groove (72) that leads into said spiral groove.

4. The connector described in claim 1 wherein:

said first unit includes a latching element (24) that has a first side (25) pivotally mounted on said second housing and that has a corner opposite said first side with said cam lying at said corner, and with said corner being biased against said first cam.

5. A connector (10) which includes first and second units (11, 12) that can be moved into connection with each other, wherein:

said second unit (12) includes a second housing (50) and a first wheel (65) that is rotatably mounted on the second housing about a first axis (80), said wheel (55) forming a spiral track (67);

said first unit (11) has a first housing (14) and has a first cam (28, FIG. 2) that is mounted on said first housing and that is engaged with said track and positioned so as said wheel turns in a first direction said second unit is moved into connection with said first unit; and including:

a second wheel (64, FIG. 4) that is rotatably mounted on said second housing to rotate about said first axis, said second wheel has a spiral second track and said first unit has a second cam engaged with said second track;

a third wheel (66) that is rotatably mounted on said second housing about a third axis that is perpendicular to said first axis;

said first, second and third wheels have gear teeth engaged with one another.

6. The connector described in claim 5 wherein:

said third wheel has an accessible manually rotatably part (69) for manual mating of said units.

7. A connector (10) which includes a second unit (12) with a second housing (50) and with a second electrical contact (56, FIG. 2) that is mounted on the second housing and that can be forced into engagement with a first electrical contact (36) that lies on a first housing of a first unit (11), wherein:

said first unit includes a pair of wheels (64, 65) each having a curved spiral track, said pair of wheels being rotatable together about a first axis (80) on said first housing;

said second unit includes a pair of cams (28) mounted on said second housing and engaged with said spiral tracks so when the wheels turn said cams move down and push said second contact into engagement with said first contact;

said spiral tracks each extends in a spiral along a majority of its curved length and extends by at least 180° about said axis.

8. The connector described in claim 7 wherein:

said first unit includes a third wheel (65) which is rotatable about a second axis that is perpendicular to said first axis, said wheels each having gear teeth engaged with gear teeth of the other wheels;

said third wheel having a tool receptacle (69) that can be engaged by a tool to rotate said third wheel.

9. The connector described in claim 8 wherein:

said first and second wheels are of the same diameter but said third wheel is of a smaller diameter than said first and second wheels.

* * * * *